US010470526B1

(12) United States Patent
Vladimirov

(10) Patent No.: US 10,470,526 B1
(45) Date of Patent: Nov. 12, 2019

(54) SHOE MEASURING DEVICE

(71) Applicant: Sergei Stanislavovich Vladimirov, Roshal' (RU)

(72) Inventor: Sergei Stanislavovich Vladimirov, Roshal' (RU)

( * ) Notice: Subject to any disclaimer, the term of this patent is extended or adjusted under 35 U.S.C. 154(b) by 0 days.

(21) Appl. No.: 16/406,462

(22) Filed: May 8, 2019

(30) Foreign Application Priority Data

Oct. 18, 2018 (RU) ..... 2018136766/12

(51) Int. Cl.
*A43D 1/06* (2006.01)

(52) U.S. Cl.
CPC ..... *A43D 1/06* (2013.01)

(58) Field of Classification Search
CPC ..... A43D 1/06
USPC ..... 33/650, 3 B, 3 C
See application file for complete search history.

(56) References Cited

U.S. PATENT DOCUMENTS 1,575,646 A * 3/1926 Scholl ..... A43D 1/02 33/3 R
1,873,532 A * 8/1932 Bliss ..... A43D 1/06 33/3 A
1,992,153 A 2/1935 Bliss
2,793,439 A * 5/1957 Simpson ..... A43D 1/027 33/3 B
3,098,301 A * 7/1963 Simpson ..... A43D 1/027 33/3 B
3,271,861 A * 9/1966 Fusco ..... A43D 1/027 33/3 B
6,192,593 B1 * 2/2001 Borchers ..... A43D 1/02 324/716
7,343,691 B2 * 3/2008 Long ..... A43D 1/06 33/3 R
8,578,534 B2 * 11/2013 Langvin ..... A43B 3/0084 12/128 R
9,514,487 B2 * 12/2016 Wilkinson ..... A41H 1/00
10,274,302 B2 * 4/2019 McGuire ..... G01B 5/012
2007/0033750 A1 * 2/2007 Cook ..... A43D 3/145 12/134
2018/0132568 A1 * 5/2018 Kim ..... G01B 5/0004

FOREIGN PATENT DOCUMENTS

CN 106510100 A 2/1935
SU 1050651 A1 10/1983
SU 1708271 A1 1/1992
WO WO-2009006989 A1 * 1/2009 ..... A43D 1/06

* cited by examiner

*Primary Examiner* — Christopher W Fulton
(74) *Attorney, Agent, or Firm* — Nadya Reingand; Yan Hankin

(57) ABSTRACT

A measuring device is disclosed which can be used in mass production of shoes. The device includes two parts: the first one is for measurement of the shoe width and girth having movable elements and the second one, which is mechanically connected with the first one, is positioned in a heel section of the shoe. The device also allows determining how tight movable elements fit to internal surface of the shoe. The first part is made in the form of a measuring head with movable cheeks and tongue placed on the toe rod, and the second part is in the form of a rod with a support roller. The mechanical connection between the parts is made in the form of a device angle measurement unit. The angle measurement unit is made using a single-turn absolute encoder. The technical result is in an increase of the accuracy of measurements.

2 Claims, 5 Drawing Sheets

SHOE MEASURING DEVICE

CROSS-REFERENCE TO RELATED APPLICATIONS

The present patent application claims priority to Russian patent application RU2018136766 filed on Oct. 18, 2018, which is incorporated herein by reference in its entirety.

FIELD OF INVENTION

The invention relates to the shoe industry, and more specifically to devices for determining the size of shoes and can be used in the measurement of the dimensional characteristics of products in mass production of shoes.

BACKGROUND

Known technical solution used as a measuring device for determining the parameters of shoes is disclosed in U.S. patent application number 20070266581. A flexible tape was chosen as a working gauge for the measurement of the shoe circumference. The principle of operation of the device is based on measuring the length of the tape that is placed inside the shoe. Effective use of this approach is possible to measure the perimeter of curved figures with obtuse angles (more than 90 degrees), since the tape, influenced by the elastic properties of the material from which it is made, must lie as tight as possible around the entire perimeter of the section being measured. The actual shape of the shoe's shoe section is closer to a triangular shape than to a round one. Complete and accurate (more than 1.5% accuracy) filling of such an asymmetric shape with a flexible tape (especially zone A) is extremely difficult. The problem also lies in the control of the complete and accurate fit of the tape to the surface of the shoe from the inside.

The disadvantage of this device is in the positioning of the measuring tape. The positioning of the measuring tape is based on measuring the length of the shoe. This approach does not allow determining with sufficient accuracy the correct distance from the heel of the shoe to the points corresponding to the measured section of the shoe for two reasons. The first reason is that when designing shoes, there is always a functional allowance (see, for example, Russian production standard GOST 3927-88) equal to about 5 mm for women's shoes and 10 mm for men to take into account the increase in foot length during walking relative to its anthropometric position. This allowance is markedly different for Russian and European sizes (partly due to this allowance there is the difference in the size grid of Russian and European shoes). So, in European footwear, the functional allowance is much larger (up to 15-20 mm). The second reason is not in the functional allowance, which theoretically can be initially included into the measurement system, but in the decorative allowance determined by fashion trends (acute/blunt/square nose).

In addition, in the analyzed device it is technically very difficult to provide the possibility of rotation of the axis of the engine in a vertical plane. Such a turn is necessary to take into account for the shoes with heels. In this known device, such an adjustment is not provided, which makes it impossible to measure the width of shoes with heels.

The closest solution to the present invention is a device for measuring parameters of a shoe, having a measurement unit with a measuring head having at least two moving parts hinged in their front part (U.S. Pat. No. 9,514,487). Parts of the measuring head can change their position relative to the specified hinge (their common point). In order to measure the size of the shoe, the parts of the head fit snugly against the inner surface of the shoe, for which they move the elements of the measuring head relative to the front hinge element.

A disadvantage of this known solution is that when the measuring head expands, its shape changes (the geometric shape of the head does not persist). When using this technology to measure width of shoes of different sizes (having different widths and girths), the required accuracy cannot be ensured due to the fundamental impossibility of achieving conformity of the shape of the moving elements. In other words, when using such a constructive solution, it is impossible to provide a measurement of the width in its necessary section, namely in the ball of the foot section.

In addition, in the known device there are no elements that provide for the measurement of the parameters of shoes with heels. The revision of the well-known device for measuring shoes with heels requires the introduction of additional nodes for transmitting the rotation, which will significantly complicate the design.

The technical problem, the solution of which is provided by the claimed invention, is the realization of the possibility of measuring the parameters of shoes with both high and low heels.

The technical result provided by the implementation of the claimed invention is to improve the accuracy of measurements.

The claimed technical result is achieved by the fact that in the measuring shoe, containing the unit determining the width and girth of the shoe and mechanically associated heel unit, where the unit determining the width and girth has at least two movable elements and means for determining the fit of the movable elements to the inner surface shoe, characterized in that the mechanical connection of the unit determining the width and girth of the shoe with the heel unit is made in the form of a unit measuring the angle of the pad, the unit determining the width and girth made in the form of a measuring head with movable cheeks and tongue placed on the toe unit, and the heel unit in the form of a rod with a support roller.

The materiality of the signs contained in the claims is confirmed by the fact that each of them separately and all of them together work to improve the accuracy of the measurements of the geometrical parameters of shoes.

The set of essential features may have a development. In particular, the unit for measuring the angle of a pad can be made as a single-turn absolute encoder located in the housing, where the toe rod with the free end rigidly connected to the encoder shaft, and the heel rod with the free end rigidly connected to the encoder housing.

BRIEF DESCRIPTION OF THE DRAWINGS

To clarify the design features of the claimed technical solution, drawings are shown, where in FIG. 1 shows a general view of a measuring block;

Figure 1:
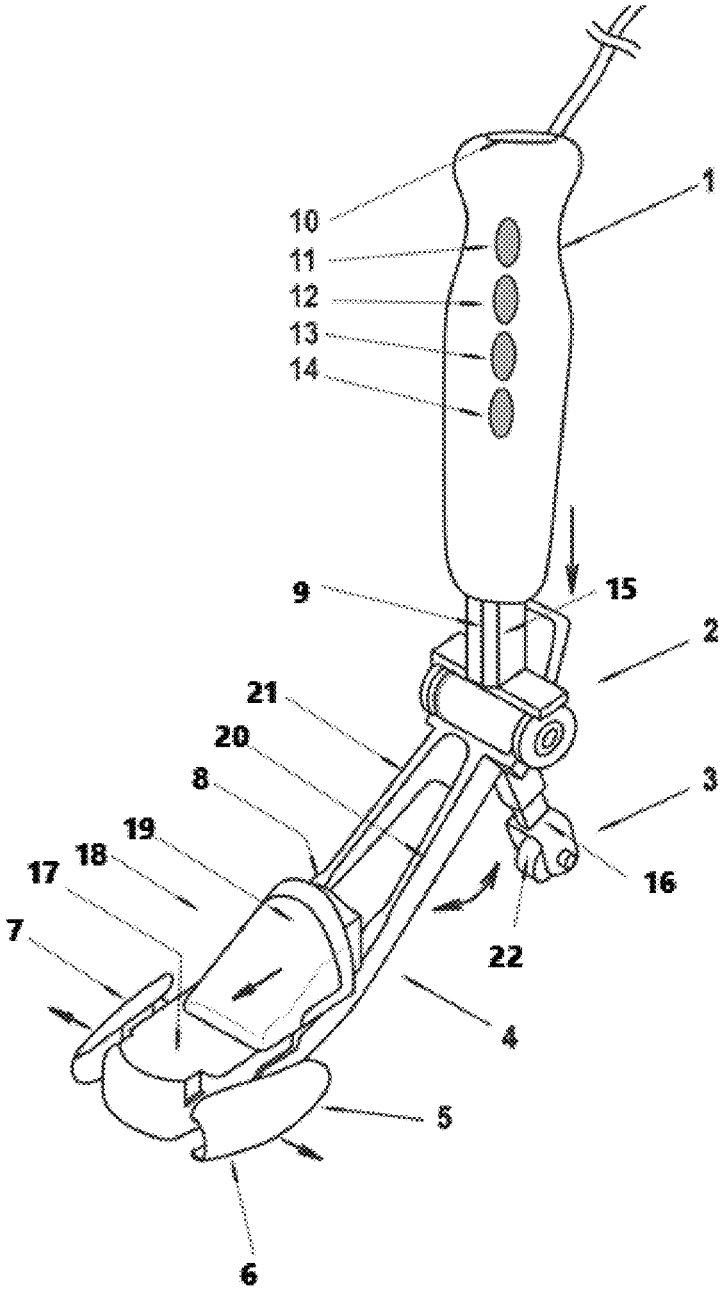

In the drawings, the following notation is used:

1—a handle, with a control and power unit located in it,

2—unit measuring the angle of the device,

3—heel unit,

4—unit determining the width and girth of shoes,
5—measuring head
6—left cheek,
7—right cheek,
8—toe rod,
9—encoder unit,
10—button for recording of parameters
11—"start" button for measuring the width,
12—"start" button for measuring the girth,
13—"emergency stop" button,
14—"reverse" button
15—arm rod
16—heel rod,
17—drive unit for cheeks,
18—drive unit for tongue,
19—tongue
20—left arm of the toe rod,
21—right arm of the toe rod,
22—heel support roller,
23—left tongue guide
24—right tongue guide
25—tongue stepper motor
26—drive screw for tongue drive
27—encoder rod,
28—encoder housing,
29—bearing
30—front stepper motor for cheek drive,
31—rear stepper motor for cheek drive,
32—pin for fastening cheek to the drive screw of the front engine,
33—pin for fastening cheek to the drive screw of the rear engine,
34—worm wheel for transmission of front engine,
35—worm wheel for transmission of rear engine,
36—shaft of worm wheel for transmission of rear engine,
37—shaft of worm wheel for transmission of front engine,
38, 40—drive screw for transmission of front engine,
39, 41—drive screw for front transmission of rear engine,
42, 43—holes for pins.

DETAILED DESCRIPTION OF THE PREFERRED EMBODIMENT

The following is a detailed description of the proposed invention with reference to the drawings.

The measuring head contains unit 4 determining the width and girth of shoes with moving elements and the heel unit 3 mechanically connected with the latter, as well as a means of determining the fit of the moving elements of the unit 4 determining the width and girth of the shoe of the inner surface of the shoe.

The unit 4 determines the width and girth of the shoe made in the form placed on the toe rod 8 measuring head 5 with movable cheeks 6, 7 and tongue 19, and the heel unit 3—in the form of a heel rod 16 with a heel support roller 22. The mechanical connection unit 4 with unit 3 in the form of unit 2 measuring the angle of the device.

The unit 2 measuring the angle of the device (FIG. 1) contains the unit 9 of the encoder housed in the encoding housing 28 (FIG. 5), with elements of independent fastening of three rods: the arm rod 15 of the handle 1, the heel rod 16, the toe rod 8. The heel rod 16 is fixed rigidly only on the encoder housing 28. The toe rod 8 is rigidly mounted only on the encoder rod 27. The arm rod 15 is fully mounted on the bearing 29 and the rotation of the encoder rod 27 relative to its housing 28 is not affected. As part of unit 2 for measuring the angle of a device, a single-turn absolute encoder is used.

The handle 1, placed on the rod 15, has an ergonomic body. Inside the body of the handle 1 is placed the power supply and control unit. The control buttons (10-14) are brought to the side surface of the handle 1 and, in the one shown in FIG. 1 example showing the implementation of the invention, are located from top to bottom: button 10 for recording of parameters, button 11 for "start" measuring width, button 12 for "start" measuring girth, button 13 for "emergency stop", button 14 for "reverse".

Means for determining the fit of movable elements to the inner surface of the shoe is implemented in hardware in the control unit. The fit algorithm uses information on the increase in current in the power supply circuit of a stepper motor, which moves the movable element, depending on the size of the contact patch of the element and the pressure exerted by the movable element on the inner surface of the shoe.

The heel unit 3 (FIG. 1) comprises a heel rod 16 and a heel support roller 22. The rod 16 is rigidly fixed to the encoder housing 28 by an upper part. In the lower part of the rod 16 is placed the heel support roller 22. The roller 22 is placed on an axis fixed in the lower part of the rod 16 and has the ability to freely rotate relative to the latter.

If necessary, the heel rod 16 can easily be replaced by an analogue of a different length, for example, when measuring high-heel shoes of small sizes—size 36 and smaller or when measuring low-heel shoes of large sizes (41 and above). The rod 16 can also be made with an adjustable length.

Figure 5:
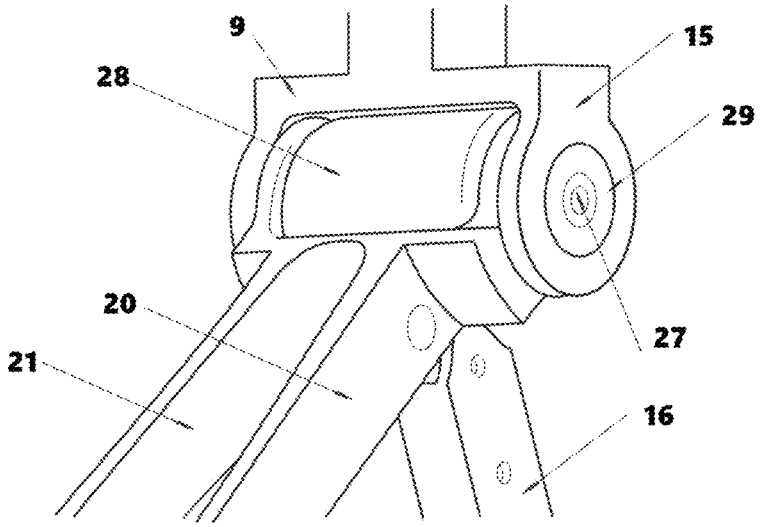
FIG. 5—unit for measuring the angle of the device.

The unit 4 determine the width and girth made in the form of a measuring head 5, which is mounted on the toe bar 8. The pivotal end of the toe rod 8 is attached to the unit 2 measuring the angle of the device, more precisely to the rod 27 of the encoder (FIG. 5).

Figure 3:
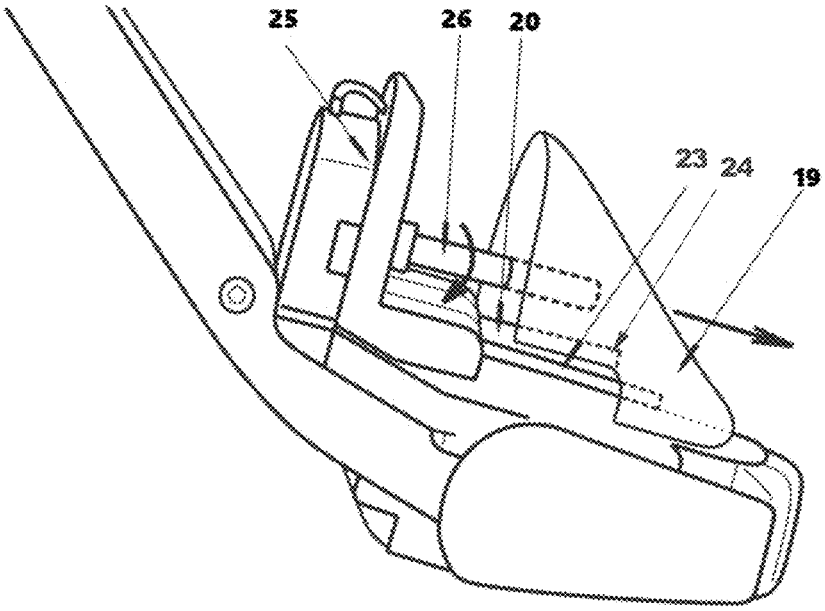
FIG. 3 shows the design of the tongue drive.
Figure 4A:
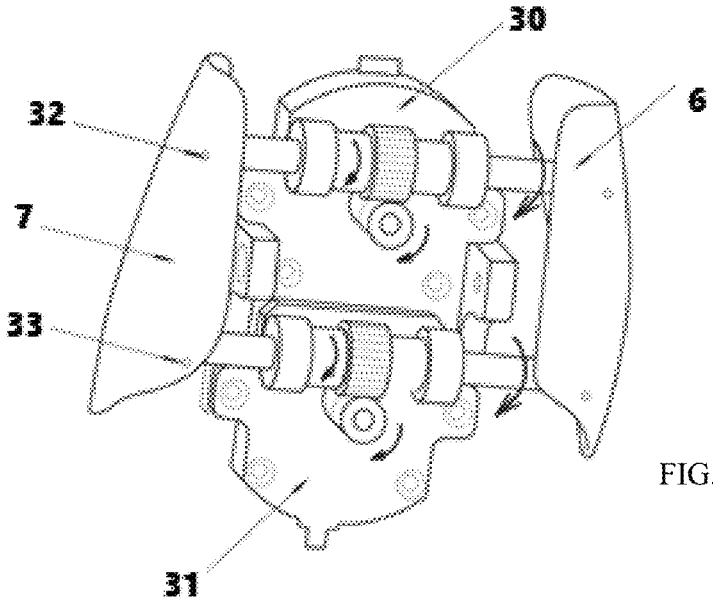
FIGS. 4A and 4B show the design of the drive for the cheeks of the measuring head.
Figure 4B:
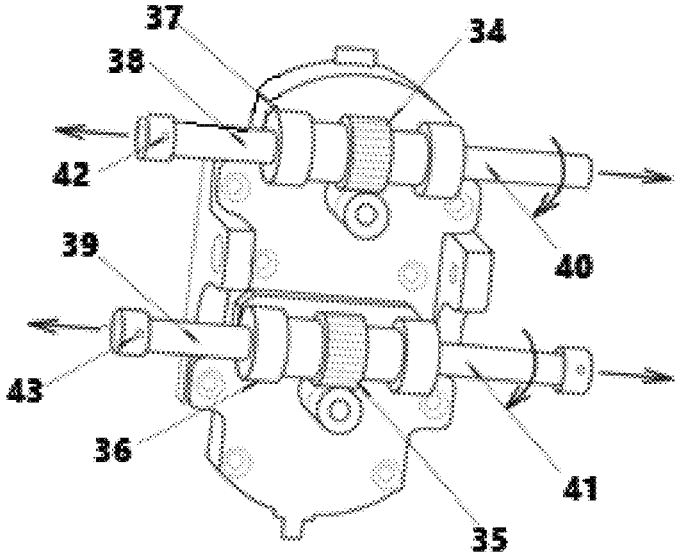

The measuring head 5 contains movable cheeks 6 and 7 with a drive unit 17 of the cheeks, a movable tongue 19 with a drive unit 18. The directions of movement of the cheeks 6, 7 and tongue 19 are shown by arrows in FIG. 1. The outer surface of the cheeks 6, 7 and the tongue 19 has a smooth streamlined shape that follows the shape of the shoe. The movement of the cheeks 6, 7 and the tongue 19 is carried out by engines 25, 30, 31 (FIGS. 3 and 4). As engines, Nema 11 stepper motors can be used.

Moving the tongue 19 along the arms 20 and 21 is carried out by means of a helical gear. The drive screw 26 articulated with the shaft of the stepping motor 25 interacts with the nut of the drive screw (not shown in FIG. 3) placed in the movable tongue 19.

The bottom view of the measuring head 5 (FIG. 4A and FIG. 4B) shows the design of the drive of the cheeks 6, 7. On the shafts of the engines 30, 31 are placed worm gears. The shafts 36, 37 of the wheels 34, 35 of the worm gears are hollow with an internal running thread. The hollow shaft performs the function of the threaded spindle nuts, the left side of the shaft having the left running thread, and the right side the right running thread. The running thread can be made directly in the shaft body or the internal cavity of the shaft can be equipped with appropriate screw nuts pressed inward. The threaded parts of the spindle screws 38, 39, 40, 41 of screw gears are placed in the corresponding threaded parts of hollow shafts 36, 37. The free ends of the spindle screws 38, 39 are fixed in the front and rear parts of the cheek 6 with pins 32 and 33 placed in the holes 42, 43 spindle screws 38, 39. Fastening the cheek 7 is carried out in a similar way. Fastening the cheeks using pins provides a slight gap in the joint, which allows for more accurate positioning of the front and back cheeks inside the shoe.

The device works and is used as follows.

Figure 2:
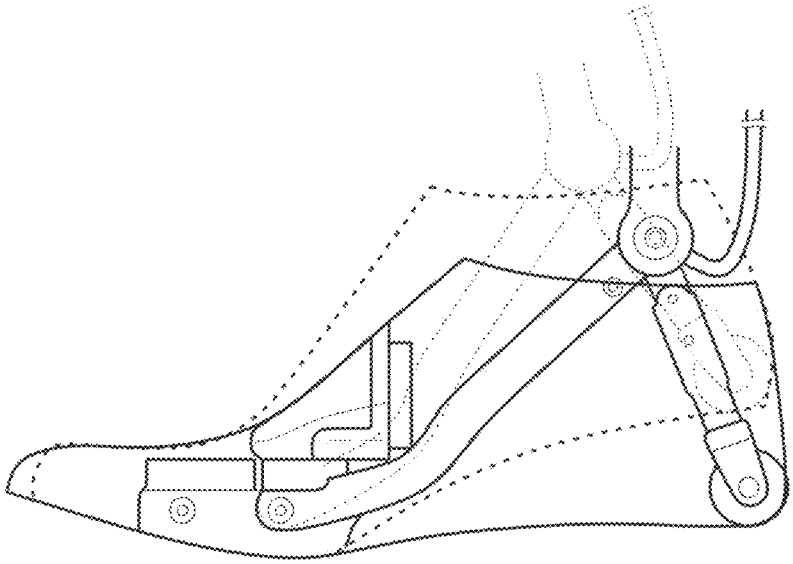
FIG. 2 is a diagram of the placement of the measuring device inside the shoe.

Stage 1—The operator, holding the handle 1, immerses the measuring block in the shoes (FIG. 2).

Stage 2—Pressing on the handle 1, the operator fixes the support heel roller 22 at the most protruding point of the heel. The measuring head 5 is positioned approximately at the widest point of the sock.

Stage 3—The operator presses the start button 11 of the width measurement. Engines 30 and 31 are turned on. The cheeks 6 and 7 move apart. The operator, by the handle 1, controls their position at the widest point of the toe. The shape of the cheeks repeats the shape of the surface of the shoe's shoe; therefore, the correct position of the measuring head 5 is visually visible.

Stage 4—The cheeks 6, 7 are moved apart until their cheek surfaces are completely in contact with the inside surface of the shoe. The pressure exerted by the cheeks on the surface of the shoe with full contact is about 1 kilogram-force per side. When the surface area of one cheek is about 3 cm2, the pressure is about 330 kilogram-force/cm2.At such pressures, the material of the shoes practically does not stretch. The pressure created leads to a peak load on the motors 30, 31. At the indicated calculated load, the interruption of the cheeks extension of about 1 kgf per side increases the current in the motor power supply circuit by about 10%. This serves as a signal for the control unit to form a command to stop the engines.

Stage 5—The operator presses the "start" button for measuring the girth and turns on the engine 25 (FIG. 3). Due to the chassis thread, the tongue 19 moves along the arms 20, 21 forward until it comes into contact with the lifting of shoes. The stop occurs at the command of the control unit, configured as described above in step 4.

Stage 6—after the shoes are filled from the inside, when the operator is visually controlled, the button 10 is pressed. When this button is pressed, the control unit records the total data: the number of steps each engine 25, 30, 31 has went, and the angle between the rods 8 and 16. This data sent for processing in the PC. The following values are uniquely determined from them: shoe size, width in the ball of the foot area, and girth in the ball of the foot area.

Stage 7—The operator presses the button 14. The working parts of the device return to their original position, the direction of rotation of all three engines is reversed. Interruption is also done by increasing the current when planting moving parts (cheeks and tongue) in the starting places.

The use of a measuring head with three movable elements in conjunction with a unit measuring the angle of the drive improves the accuracy of measurement of footwear parameters.

What is claimed is:

1. A device for measuring a shoe, comprising a first part for measuring a width and a girth of the shoe with a mechanical connection with a second part, the second part being a heel part, the first part having at least two movable elements and means for measuring a tightness of a fit of the movable elements to an inner surface of the shoe, wherein the mechanical connection between the first and the second parts is made in a form of a unit for measuring an angle between rods of the first and the second parts, the first part is made in a form of a measuring head on the toe rod, the measuring head having movable cheeks and a tongue, and the second part is made in a form of the rod with a support roller.

2. The device according to claim 1, wherein the unit for measuring the angle is made as a single-turn absolute encoder positioned in a housing, with a free end of the toe rod being rigidly connected to a shaft of the encoder, and a heel rod having its free end rigidly connected with the encoder housing.

* * * * *